United States Patent [19]

Greene

[11] Patent Number: 4,686,923

[45] Date of Patent: Aug. 18, 1987

[54] SAILBOAT KEEL HAVING A CANTILEVERED TRAILING EDGE FLAP

[75] Inventor: Leonard M. Greene, White Plains, N.Y.

[73] Assignee: Safe Flight Instrument Corporation, White Plains, N.Y.

[21] Appl. No.: 889,165

[22] Filed: Jul. 25, 1986

[51] Int. Cl.[4] ..... B63B 3/38

[52] U.S. Cl. ..... 114/140

[58] Field of Search ..... 114/39.1, 121, 126–143

[56] References Cited

U.S. PATENT DOCUMENTS

| | | | |
|---|---|---|---|
| 3,080,845 | 3/1963 | Pollak | 114/140 |
| 4,077,077 | 3/1978 | Harper | 114/140 |
| 4,089,286 | 5/1978 | Scheel | 114/140 |
| 4,453,484 | 6/1984 | Englund | 114/143 |

*Primary Examiner*—Joseph F. Peters, Jr.
*Assistant Examiner*—Stephen P. Avila
*Attorney, Agent, or Firm*—Edward A. Sokolski

[57] ABSTRACT

A keel assembly for a sailboat, the keel assembly having wing-like appendages at the bottom of a fixed keel and having a rotatable flap located at the trailing edge of the fixed keel. The flap includes a cantilevered portion extending below the vertical portion of the keel. In operation, the flap is rotated a few degrees to one side or the other of the center line of the boat so as to create an asymmetrically shaped keel so that the keel and hull exhibit a high lift to drag ratio and efficient sailing performance.

4 Claims, 11 Drawing Figures

SAILBOAT KEEL HAVING A CANTILEVERED TRAILING EDGE FLAP

BACKGROUND OF THE INVENTION

1. Field of the Invention

One of the important functions that the keel on a sailboat performs is to impede the movement of the boat sideways through the water (i.e., impede "leeway") while facilitating forward motion of the boat through the water (i.e., allowing "headway"). The control of leeway is particularly important when the sailboat is sailing "to weather" that is when the boat is sailing upwind at an angle of typically 35 to 45 degrees from the direction from which the wind is blowing.

FIG. 1 depicts a sailboat 1 sailing upwind on starboard tack at an angle 2 of approximately 45 degrees from the direction 3 from which the wind is blowing. Because of the force of the wind on the sails of the boat, the movement of the boat through the water, as represented by vector 4, normally is not quite in line with the center line 5 of the boat. The force of the wind instead causes the motion of the boat through the water to have a component represented by vector 6 ("leeway") at right angles to the center line of the boat and a component 7 ("headway") along the center line of the boat.

FIGS. *2a* and *b* depict a sailboat 8 of the prior art having a hull 9 to which is attached a keel 10 and a rudder 11. The longitudinal dimension of keel 10 is aligned with the center line of the boat so as to impede leeway and facilitate headway.

In the prior art, keel 10 normally has a cross section which is symmetrical with respect to the center line of the boat. Because the keel moves through the water at a slight angle to the axis of symmetry, the keel generates "lift" in the direction opposite to that of the vector 6 in FIG. 1 and it is this "lift" that impedes leeway. The keel also generates drag, which drag resists the forward motion or headway of the yacht. A measure of the performance of the keel in resisting leeway while allowing headway is the ratio of lift to drag, i.e., the lift-drag ratio.

2. Description of the Prior Art

As depicted in FIG. *2a*, a few racing sailboats, most notably some of the prior contenders for the America's Cup Competition, added a trim tab (or in aerodynamic nomenclature, a trailing edge flap) to the trailing edge 7 of keel 10. Trim tab 5 is attached to trailing edge 7 of keel 10 in a manner such that tab 5 can be rotated about an axis located adjacent to trailing edge 7 of the keel so as to move trailing edge 6 of the tab from side to side of the centerline of the boat.

In such prior art boats, a primary purpose of the trim tab was to act as a second rudder, which rudder is then readjusted from time to time to various fixed positions so as to "trim" the amount of the steering force that must be provided by rudder 11 to a small value. A secondary purpose for adjusting the position of the trim tab to one side or the other of the centerline was to alter the effective shape of the combination of the keel and trim tab to an asymmetrical shape such that the asymmetrical combination of the keel and trim tab, operating in cooperation with the hull of the boat, would exhibit a higher lift to drag ratio than would be exhibited by a symmetrical keel and hull. An example is depicted in FIG. 1 which indicates the starboard side 12 and the port side 13 of the sailboat. In the circumstances depicted in FIG. 1, where the wind is blowing on the starboard side of the boat, the trim tab 7 would be rotated a few degrees from the centerline so as to place the trailing edge 6 on the port side of the boat.

A disadvantage of the prior art keel described above, is that trim tab 5 must be rotated several degrees in order to obtain a small change in the effective angle of attack of the keel and trim tab assembly relative to the center line of the boat. Such a large rotation of tab 5 causes a reduction in the lift to drag ratio of the combination of the tab and keel relative to that produced by the present invention.

FIGS. *3a* and *b* depict a different development in the keels used in the prior art by America's Cup competitors. Most notably, a keel similar to that depicted in FIGS. *3a* and *b* was used by the successful Australian contender in 1982. In FIGS. *3a* and *b*, keel 13 has a vertically oriented body and, in addition, has a pair of wing like appendages 15 extending sideways from the bottom of the vertical portion 14 of the keel and angling downwards slightly from the horizontal forming a wing like shape extending from the lower portion of the keel. The appendages 15 serve two purposes. First, when the boat is sailing upwind, appendages 15 act as a barrier or cap at the bottom edge of the keel that obstructs the formation of vortex flow around the bottom edge of the vertical portion 14 of the keel and thus avoids a reduction in the lift generated by the keel that otherwise would result from such vortex flow. As a consequence, the appendages can improve the lift to drag ratio of the hull and keel combination. Second, as depicted in FIG. 4, when the boat is heeled while sailing upwind, the leeward appendage 15 is positioned more deeply in the water, at depth 16, than would a conventional keel (depth 17) of equal depth when not heeled. Thus, when the boat is heeled over, the additional effective depth of the keel also may operate to improve the effective lift to drag ratio of the combination of the hull and keel.

SUMMARY OF THE INVENTION

The present invention uses a much larger tab or flap attached to the trailing edge of a keel having wing-like appendages at its bottom. Because of the much greater size of this "trailing edge flap", the effect of a modest angular deflection of the flap produces a greater asymmetry to the hull and keel and, for this reason the flap, in combination with the keel, exhibits an improved lift to drag ratio. The words "lift, drag and trailing edge flap" are taken from the aerodynamic nomenclature and hold similar meanings here.

In addition, the trailing edge flap of this invention has a portion thereof which extends below the bottom of the vertical portion of the keel. The portion of the flap extending below the bottom of the vertical portion of the keel is referred to herein as the "cantilevered" portion of the flap. Typically, the laminar flow of water along the keel has separated from the keel by the time it reaches the portion of the flap located behind the keel. As a consequence, the effectiveness of the portion of the flap behind the keel, (and the effectiveness of the prior art trim tab), is diminished from that which would obtain in laminar flow. In contrast to the turbulent flow of water past the portion of the flap located above the bottom of the keel, the water flows in a laminar manner past the cantilevered portion of the flap. As a consequence the cantilevered portion of the flap, when placed at an angle to the laminar flow of water, exhibits a higher lift to drag ratio than does the vertical portion of the keel and the portion of the flap trailing thereto.

Finally, the vortex flow of water, that otherwise would appear at the bottom edge of a prior art keel and interfere with the efficient operation of the cantilevered portion of the flap, is prevented from so appearing by the wing-like appendages at the bottom of the fixed keel.

Thus, as a consequence of the increased size of the flap, the operation of the cantilevered portion of the flap in a laminar flow of water and the interaction of the appendages and the cantilevered portion of the flap, the flap in combination with the keel and the hull of the boat exhibit improved performance as measured by the lift to drag ratio.

DESCRIPTION OF THE PREFERRED EMBODIMENT

Throughout this specification, the terms downward, sideways, forward and aft refer to directions relative to the hull of a sailboat when the sailboat is in an upright position, that is, in its normal floating attitude when at rest. "Leading edge" refers to that edge of the body nearest the bow of the boat, and "trailing edge" refers to that portion of the body nearest the stern of the boat. The "longitudinal axis" of a boat is equivalent to the centerline 36 of hull 18, as depicted in FIGS. 5*a* and *b*.

Figure 5A:
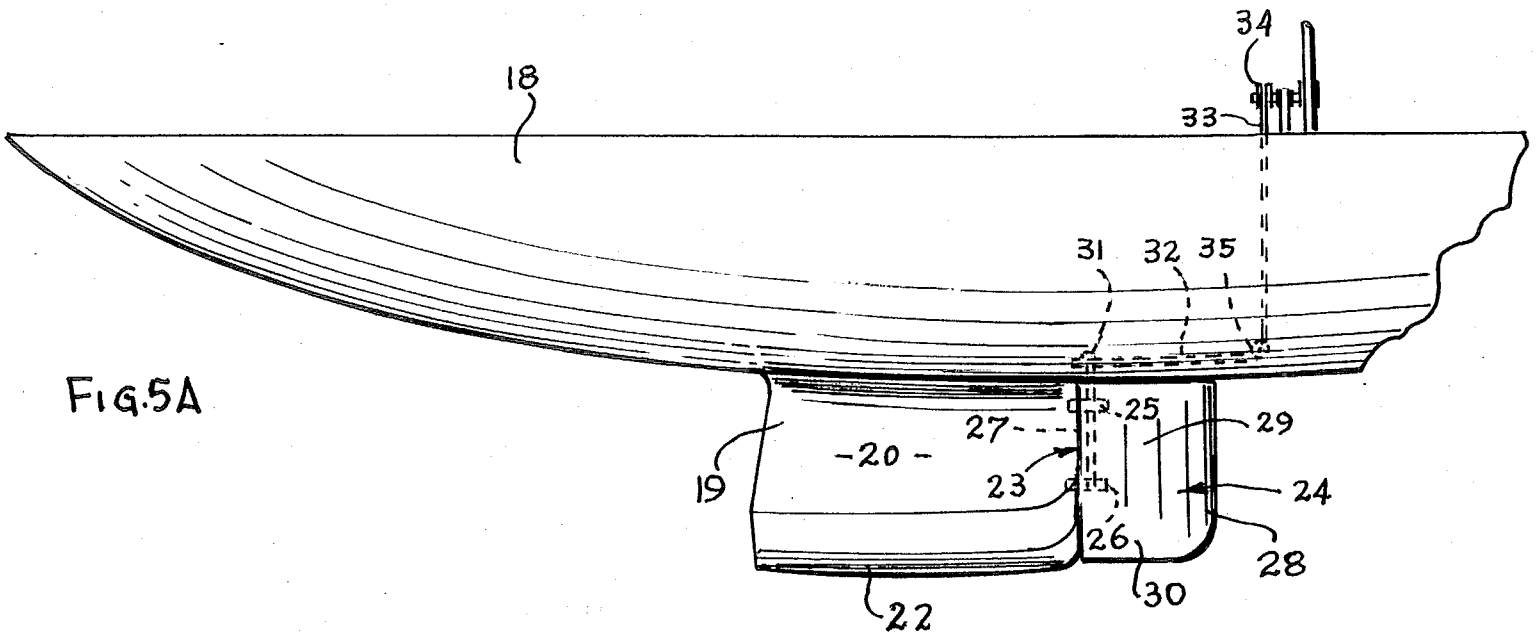
FIGS. 5*a*, 5*b*, and 5*c* and 5*d* are side, bottom, front and rear views respectively of a sailboat and the keel of this invention.
Figure 5B:
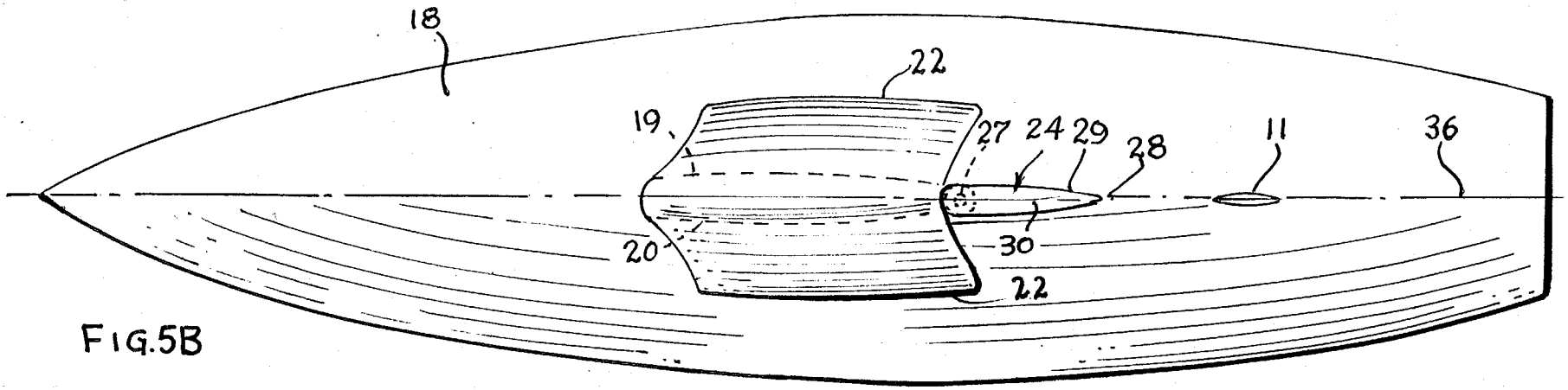
Figure 5C:
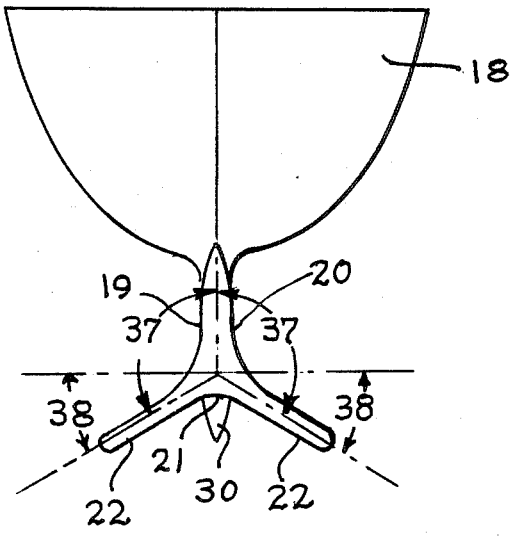
Figure 5D:
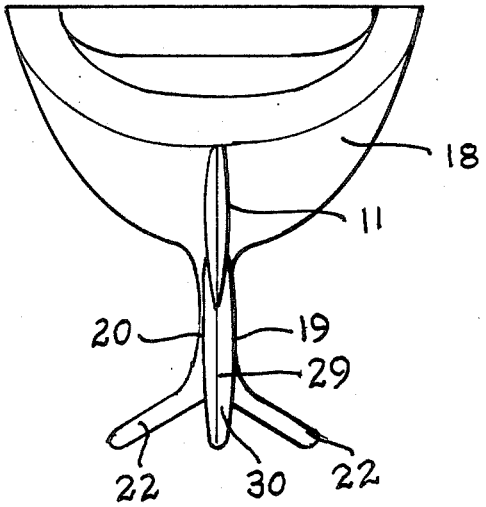

Referring to FIGS. 5*a*, *b*, *c* and *d*, hull 18 has a keel assembly 19 which has a vertical portion 20, which vertical portion extends from the hull in a downward direction. The longitudinal axis of the vertical portion 20 of the keel is oriented parallel to the longitudinal axis of the boat. As depicted in FIG. 5*c*, at the bottom 21 of the vertical portion 20 of the keel, the keel assembly has wing-like appendages 22 which extend from a point near the bottom of the keel sideways, to port and to starboard, and downward at an obtuse angle 37, of approximately 110 to 130 degrees from the vertical, which appendages exhibit negative dihedral angles 38, to the horizontal.

Figure 6:
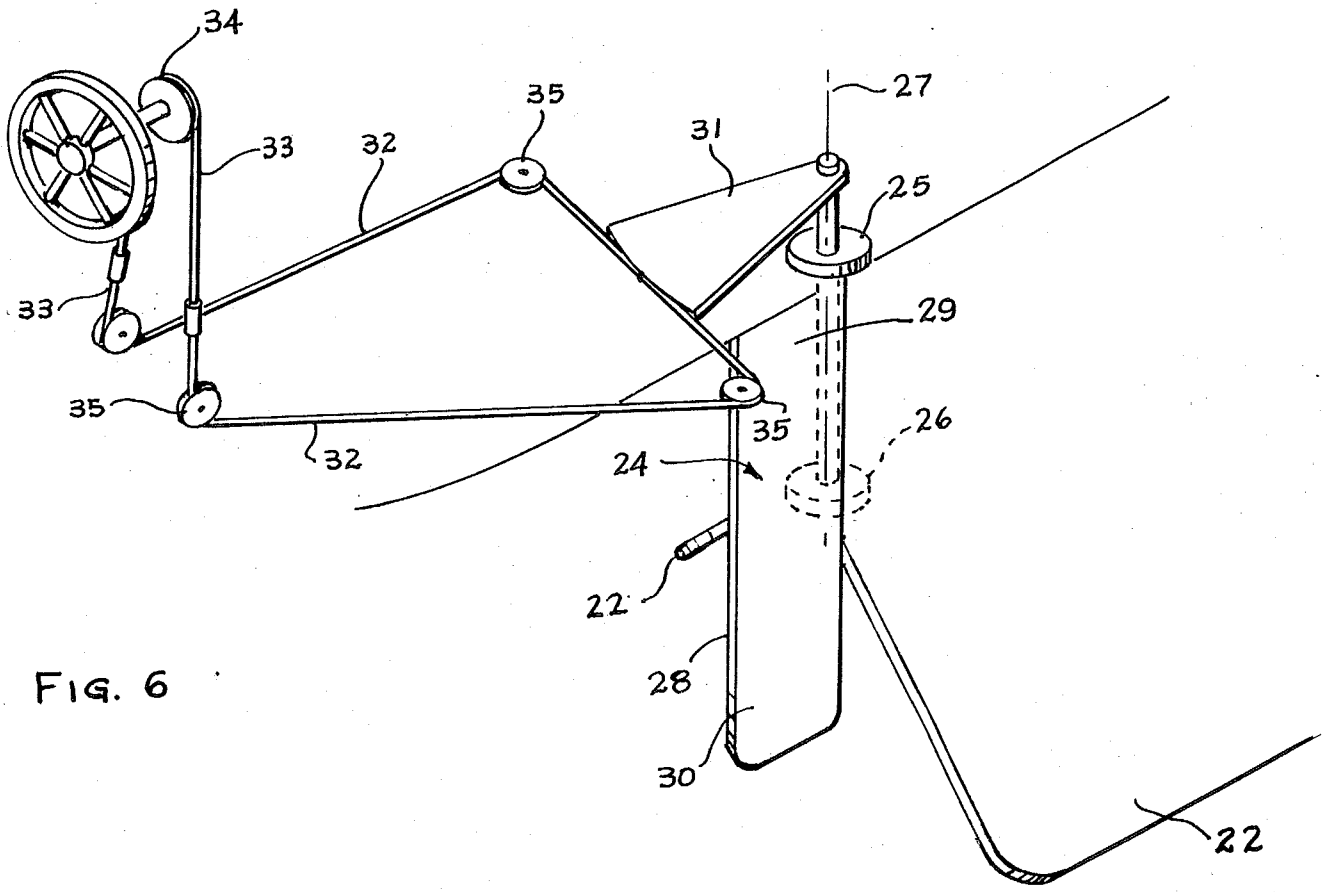
FIG. 6 is a pictorial depiction of a system for supporting, changing and controlling the position of the cantilevered flap of this invention.

A flap 24 is supported at or near the trailing edge 23 of vertical portion 20 of the keel. The flap is supported by bearings 25 and 26 as depicted in FIG. 6 and is free to rotate about axis 27. By rotating flap 24 about axis 27, the trailing edge 28 of the flap can be moved from side to side of the boat.

Flap 24 has a portion 29 which is located behind the vertical portion 20 of the keel. Flap 24 also has a cantilevered portion 30 which extends below the vertical portion 20 of the keel. The portion of flap 24 which extends below the vertical portion of the keel is referred to herein and in the claims as the cantilevered portion of the flap.

FIG. 6 depicts a quadrant 31, cable 32, chain 33, sprocket and wheel assembly 34 and turning blocks 35 that are used to control and adjust the angular position of the flap relative to the fixed portion of the keel.

Figure 1:
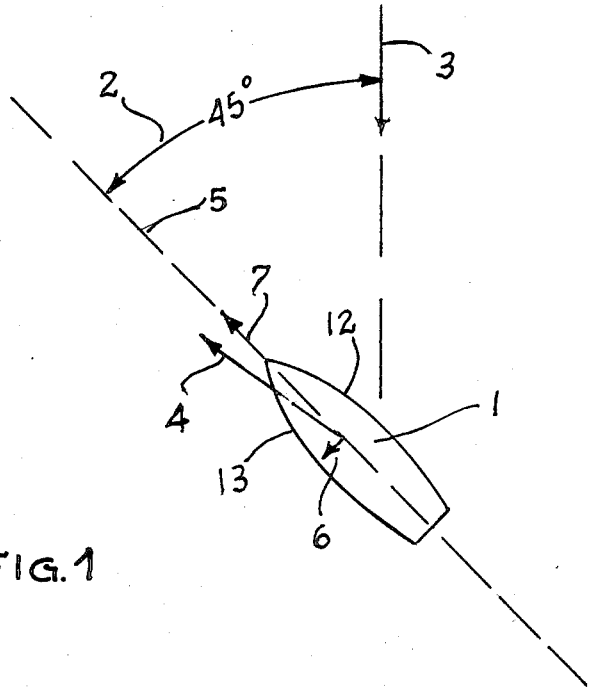
FIG. 1 illustrates the relationships between headway, leeway and the motion of the boat through the water.
Figure 4:
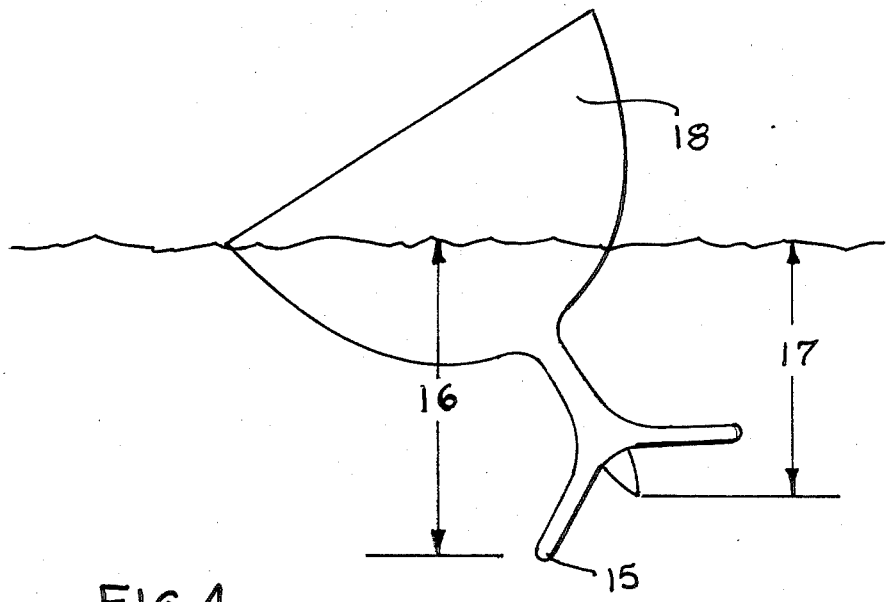
FIG. 4 depicts a boat, with a winged keel, in a heeled attitude.
Figure 2A:
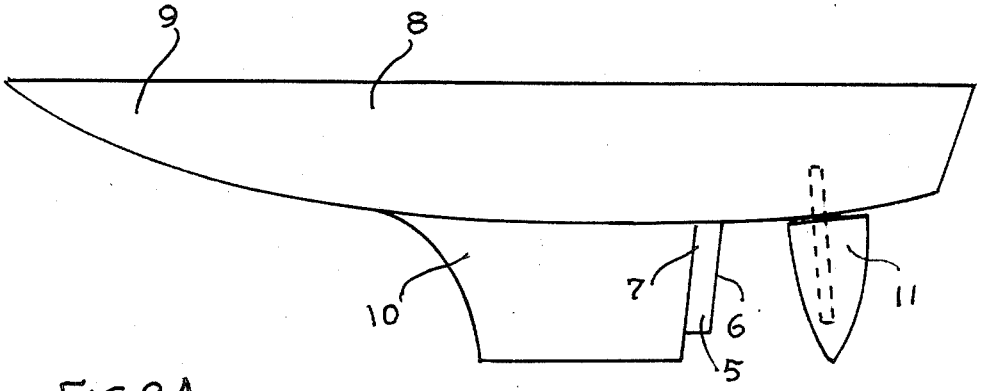
FIG. 2A PRIOR ART
FIGS. 2*a* and *b* depict a sailboat of the prior art having a trim tab attached to the keel.
Figure 2B:
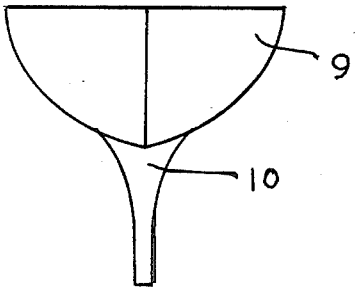
Figure 3A:
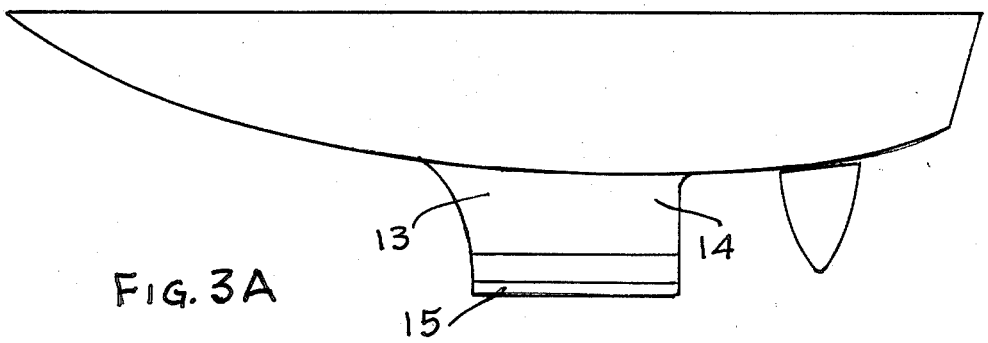
FIG. 3A PRIOR ART
FIGS. 3*a* and *b* depict a sailboat of the prior art having wing-like appendages at the bottom of the keel.
Figure 3B:
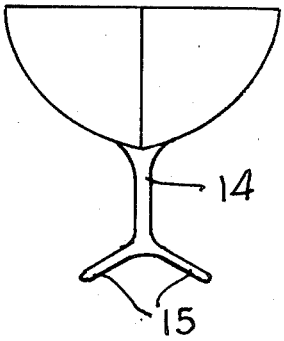

When sailing "to weather" in the manner depicted in FIG. 1, the angular position of flap 24 is adjusted so that the trailing edge 28 of the flap is offset from the center line 36 (shown in FIG. 5*b*) of the hull to the leeward side of the boat so that the flap is oriented at an angle of a few degrees from that of the center line 36 of the boat. As a consequence of the angular offset, the flap, together with the fixed portion of the keel, exhibit an asymmetrical shape and provide an improved lift to drag ratio compared to a symmetrical keel. The cantilevered portion 30 of the flap which protrudes into a laminar flow of water exhibits a still better lift to drag ratio. In addition, the wing-like appendages operate as an "end-cap" to prevent a vortex flow of water at the bottom of the vertical portion of the keel, and thus prevents such a vortex flow from interfering with the efficient operation of the cantilevered portion of the flap. As a consequence the cantilevered flap, the fixed keel and the hull of the boat together exhibit an improved lift to drag ratio.

Although the invention has been described in terms of its operation when the boat is sailing upwind, it should be understood that improved reaching and running performance also may be obtained by use of the invention.

I claim:

1. A keel assembly for a sailboat, the sailboat being of the type having a single hull to which the keel assembly is attached and having a rudder attached to the hull, the rudder being separate from the keel assembly, and the sailboat having a longitudinal axis, comprising a fixed keel affixed to the hull, the fixed keel having a vertical portion extending downward from the hull and having a longitudinal axis oriented parallel to the longitudinal axis of the hull, the vertical portion of the fixed keel having port and starboard sides, a trailing edge and a bottom and bottom edge, the fixed keel further having port and starboard wing-like appendages located near the bottom of the vertical portion of the fixed keel and extending respectively from the port and starboard sides of the vertical portion of the fixed keel, the wing like appendages extending in directions substantially transverse to the longitudinal axis of the boat, a rotatably mounted flap, the flap having a main body, a cantilevered portion and a leading edge, means for rotatably supporting the flap for rotation about an axis of rotation, the axis of rotation being adjacent to the leading edge of the flap and being located adjacent to the trailing edge of the vertical portion of the fixed keel.

the cantilevered portion of the flap extending downward from the main body of the flap and extending downward below the bottom edge of the vertical portion of the fixed keel, means for adjusting and maintaining the angle of rotation of the flap so as to improve the lift to drag ratio of the keel assembly.

2. The keel assembly described in claim 1 wherein the port and starboard wing-like appendages extend at angles from the vertical portion of the fixed keel so as to exhibit negative dihedral angles to the horizontal, and wherein the cantilevered portion of the flap which extends below the bottom of the vertical portion of the fixed keel does not extend downwards substantially below the lower most portions of the wing-like appendages.

3. The keel assembly described in claim 1 wherein the wing-like appendages operate to prevent substantially the interference of any vortices emanating from the fixed portion of the keel with the cantilevered portion of the flap.

4. The keel assembly described in claim 2 wherein the wing-like appendages operate to prevent substantially the interference of any vortices emanating from the fixed portion of the keel with the cantilevered portion of the flap.

* * * * *